US009146064B2

(12) United States Patent
Whittington

(10) Patent No.: US 9,146,064 B2
(45) Date of Patent: Sep. 29, 2015

(54) RAPID FIRE APPARATUS FOR SEMI-AUTOMATIC FIREARMS

(71) Applicant: Aaron Jesse Whittington, Canal Winchester, OH (US)

(72) Inventor: Aaron Jesse Whittington, Canal Winchester, OH (US)

( * ) Notice: Subject to any disclaimer, the term of this patent is extended or adjusted under 35 U.S.C. 154(b) by 0 days.

(21) Appl. No.: 14/145,491

(22) Filed: Dec. 31, 2013

(65) Prior Publication Data

US 2015/0184967 A1 Jul. 2, 2015

(51) Int. Cl.
*F41A 19/00* (2006.01)
*F41A 19/09* (2006.01)

(52) U.S. Cl.
CPC ..... *F41A 19/00* (2013.01); *F41A 19/09* (2013.01)

(58) Field of Classification Search
CPC ..... F41A 19/00; F41A 19/03; F41A 19/04; F41A 19/08; F41A 19/09; F41A 19/10; F41A 19/16; F41A 19/17
USPC ..... 89/136; 42/69.01
See application file for complete search history.

(56) References Cited

U.S. PATENT DOCUMENTS

| | | | | | |
|---|---|---|---|---|---|
| 2,097,962 | A | * | 11/1937 | Boussel | 89/127 |
| 3,828,458 | A | * | 8/1974 | Skone-Palmer | 42/69.01 |
| 5,890,479 | A | | 4/1999 | Morin | |
| 6,101,918 | A | * | 8/2000 | Akins | 89/129.01 |
| 6,142,137 | A | * | 11/2000 | MacLaughlin | 124/72 |
| 6,550,468 | B1 | * | 4/2003 | Tippmann, Jr. | 124/71 |
| 2005/0178373 | A1 | * | 8/2005 | Hatcher | 124/31 |
| 2014/0259845 | A1 | * | 9/2014 | Johnson | 42/69.01 |

* cited by examiner

*Primary Examiner* — Gabriel Klein
(74) *Attorney, Agent, or Firm* — Barney DeBrosse LLC; Matthew Upton

(57) ABSTRACT

A device for increasing the rate of fire of a firearm is described herein. The inventive device includes pneumatic components having a cylinder having a rod therein. A controller is also included for activating the extension of the rod from the cylinder and a switch is present for monitoring the location of the firearm's trigger. A canister of compressed gas is provided to power the cylinder and the rod therein.

3 Claims, 5 Drawing Sheets

Main View and Bill of Materials
-Shows General operating components

DETAIL C
(TRIGGER RESET)

RAPID FIRE APPARATUS FOR SEMI-AUTOMATIC FIREARMS

TECHNICAL FIELD

Exemplary embodiments of the present invention relate generally to semi-automatic firearms, and more specifically to apparatus mounted thereon to supplement trigger return spring forces for increasing the fire rate of the firearm.

BACKGROUND OF THE INVENTION

Many recreational shooters and firearms enthusiasts would like the opportunity to fire automatic firearms. However, private citizens cannot, legally own automatic firearms produced after a certain date, resulting in a finite and dwindling number of legal automatic firearms. The finite supply of legally transferrable automatic firearms and their growing demand has lead to extremely high prices. Most of the consuming public cannot afford to own such weapons. This has lead to an increasing demand for rapid fire semi-automatic attachments and modifications, often referred to as trigger activators, which can be legally owned and used by members of the general public.

Many prior attempts to provide rapid fire firearm attachments make use of external springs to supplement the force of the trigger return spring during the process of resetting the trigger after each round is fired in order to allow the user to pull the trigger more rapidly. These solutions, however, alter the shooting experience by increasing the force required to pull the trigger and fire a round. Other similar attempts to improve the speed of semi-automatic fire also require the use of special fire techniques, or the attachment of special parts to the firearm that are not readily removed and can cause awkward and inaccurate shooting.

It is therefore an unmet need in the prior art for an apparatus that may be readily attached to a firearm, thereby increasing its firing rate without altering the shooting experience.

BRIEF SUMMARY OF THE INVENTION

Exemplary embodiments of the present disclosure pertain to a device mounted on a semi-automatic weapon to supplement trigger return to increase the fire rate of a firearm. The Exemplary embodiments described herein include pneumatic components used to drive the trigger back into the fire ready position after the trigger has been used to fire the weapon. The pneumatic components of include a pneumatic cylinder having an extendable rod therein. The rod is used to engage and apply force to the trigger to return the trigger to the fire ready position after firing. The cylinder is connected to a solenoid valve or other similar device by way of a hose, and the solenoid valve is supplied with compressed gas from a canister by an additional hose. The canister may be integrated into the body of the firearm or be separate therefrom.

The solenoid valve is actuated by an electrical circuit that includes a power source, a controller (including a timing circuit), and trigger position switch. The power source may be batteries or a rechargeable power cell. The controller may be a microchip, a printed circuit board or a combination thereof. The controller receives a signal from the trigger switch indicating that the trigger has been pulled and the weapon fired. The controller then sends a signal to the solenoid valve directing the pneumatic cylinder to fire resulting on the rod extending from the cylinder and contacting the trigger to assist the trigger into the fire ready position. The cylinder is then directed to retract, or the pneumatic pressure may be vented from the cylinder, removing the force applied to the rod, so that the trigger may be pulled again, activating the device again. In this manner, a faster rate of firing a firearm is achieved while still requiring that a trigger be actuated for each individual firing of the weapon.

In other exemplary embodiments, the trigger switch may be removed and a reed switch may be used in proximity to the cylinder. In this embodiment, the reed switch is used to determine when the trigger has been actuated. As the trigger is actuated, the trigger depresses the rod and this movement of the rod, having magnetic elements, is detected by the reed switch. The reed switch then sends the signal to the controller to activate the solenoid and fire the cylinder. Again after the rod has been extended from the cylinder returning the trigger to the fire ready position, the pressure on the cylinder is released and the rod is able to be retracted by the subsequent trigger pull.

In some embodiments the cylinder is located in the grip of the firearm. In some embodiment, the cylinder as well as the solenoid, reed switch, the controller and power supply may all be located in the grip of a firearm. In still other embodiments of the invention, the elements of the inventive device may be located on the rail found on firearms, such as those used with pistols.

The device provides the advantage of increasing the rate of fire of the firearm to which it is attached, while still requiring a trigger pull for each firing of the weapon. These and other advantages are provided by the invention described and shown in more detail below.

BRIEF DESCRIPTION OF THE SEVERAL VIEWS OF THE DRAWINGS

Novel features and advantages of the present invention, in addition to those mentioned above, will become apparent to those skilled in the art from a reading of the following detailed description in conjunction with the accompanying drawings wherein identical reference characters refer to identical parts and in which.

DETAILED DESCRIPTION OF THE INVENTION

Figure 1:
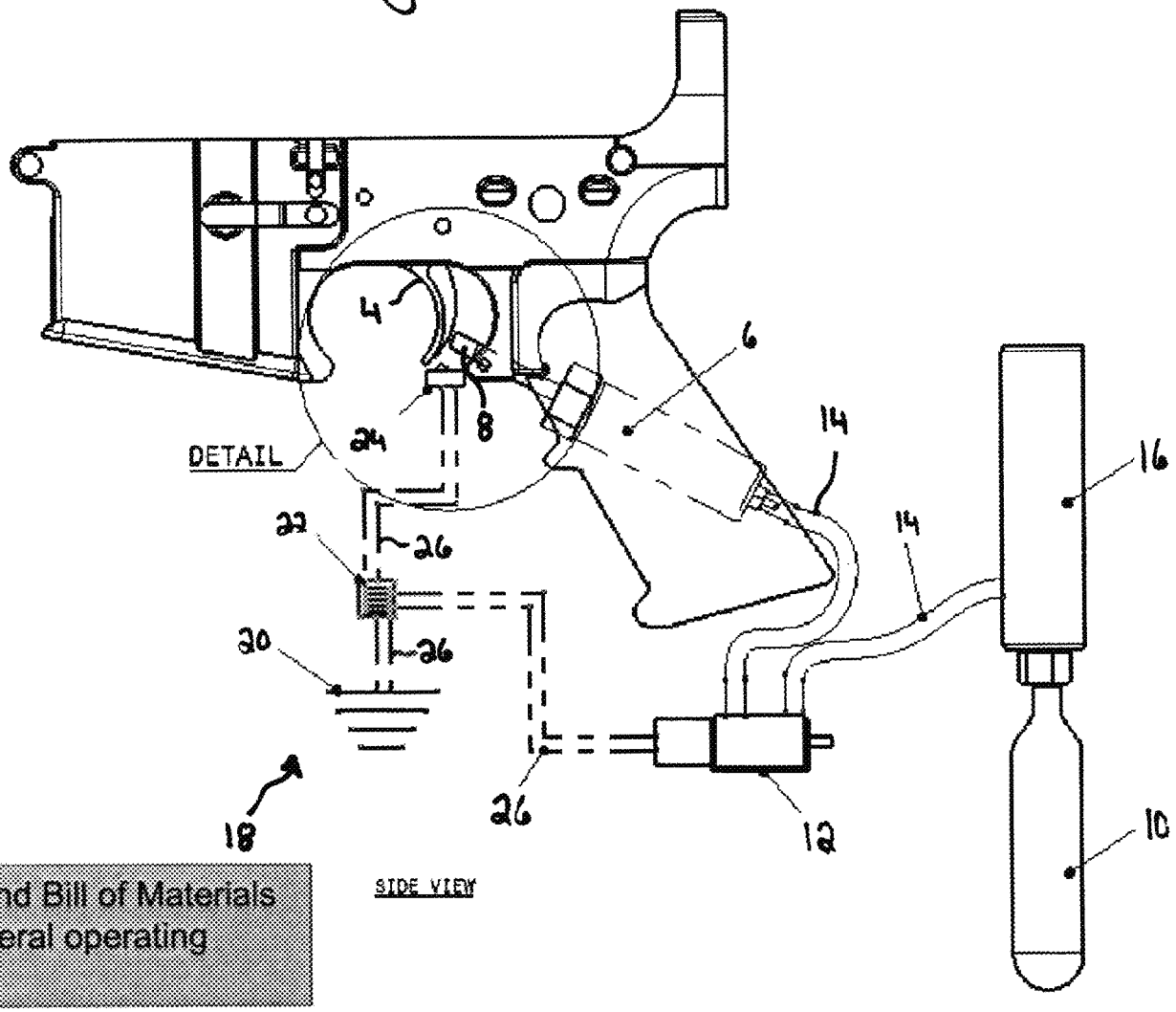
FIG. 1 depicts a side view of a semi-automatic style firearm with the components of a first embodiment of the invention in schematic layout.

The invention is embodied as an apparatus that is attachable to a firearm and operates to increase the rate of fire without altering the characteristics of the firearm or affecting the shooting experience. The apparatus generally operates to apply a supplemental restorative force to the trigger to aid in resetting the firing mechanism more rapidly, without affecting the feel or pull weight of the trigger.

Semi-automatic firearms employ a variety of firing mechanisms to carry out the firing of loaded rounds. The firing mechanism is actuated by a trigger that is pulled or squeezed by the user firing the firearm. A trigger typically acts as a lever and rotates around a pivot point when squeezed, defining a trigger travel distance traversed by the trigger. When a firearm is loaded with a projectile and prepared for shooting, the trigger is generally in a fire ready position. The fire ready position may be the forward most position of the trigger, but may also encompass positions between the position of a resting trigger and a rearward secondary position that may be occupied by the trigger that does not result in actuation of the firing mechanism. As used herein, the "fire ready position" is defined as any trigger position from which a firing sequence may be initiated.

When the trigger is pulled past a firing position, it actuates the firing mechanism by, for example, releasing the hammer or striker and initiating the firing of the loaded projectile. In many firearms, the trigger continues to move rearward of the firing position through a distance referred to as "over travel." If pulling pressure continues to be applied by the shooter, the trigger will eventually reach the rearward bounds of its movement at a "travel stop position." Those skilled in the art will appreciate that, depending on the particular firearm, firing mechanism and trigger combination used, there will be a "reset position" that exists at or between the firing position and the travel stop position as an optimal position to cease rearward trigger movement and reset the trigger to a fire ready position.

The invention is embodied in a firearm attachment having a returning means for forcibly returning the trigger to a fire ready position from a reset position, and a switching means for switching the returning means between active and inactive states. The returning means utilizes a force applicator to apply a force supplemental in nature to the trigger return spring directly to the trigger. The returning means has an energy source operably connected to the force applicator such that the energy source may be applied to drive the force applicator. The returning means has an active state in which the force applicator is driven by the energy source, and an inactive state in which the force applicator is not driven by the energy source.

When the returning means is in the active state, the force applicator is driven by the energy source, imparting force supplemental to the trigger return spring, thereby forcing the trigger toward the fire ready position. Once the trigger is in the fire ready position, the switching means switches the returning means to its inactive state, disengaging the energy source and removing the supplemental force applied by the force applicator. The switch from the active state to the inactive state disengages the returning means from the trigger in that the returning means no longer affects the feel or pull weight of the trigger when the user proceeds to initiate the firing of the next chambered round. As described in detail more fully below, the apparatus is also mountable on the firearm in such a manner as not to affect the shooting experience.

A preferred embodiment of the apparatus is depicted in schematic view in FIG. 1. The relevant components of a semi-automatic firearm are shown generally at 2. The basic firearm components 2 depicted are similar to those in an AR-15 style, semi-automatic firearm for illustrative purposes. Those skilled in the art will appreciate that the disclosed embodiment may be applied to other types and styles of semi-automatic firearms without departing from the disclosure herein. A trigger 4 for actuating the firing mechanism (not shown) is also depicted in FIG. 1.

The preferred embodiment of the invention employs pneumatic components to carry out the functionality described generally above. The apparatus components include a pneumatic cylinder 6 having an extendable rod, ram, pushrod, or plunger 8 used as the force applicator. Other suitable force applicators that may be employed include, for instance, electromechanical solenoids. While the pneumatic cylinder 6 is shown in FIG. 1 oriented to apply a driving force to the trigger to push the trigger from the rear, it should be recognized that a force applicator may be mounted on the barrel side of the trigger with a linkage adapted to apply a pulling force to the trigger so that it may be reset. The latter orientation of the force applicator may be preferred for semi-automatic style handguns in order not to impair the shooting experience.

The preferred embodiment uses a source of compressed gas 10 to drive the pneumatic cylinder 6 in the active state. The source of compressed gas 10 may be a tank, cartridge or other such similar storage systems. The gas itself may be any suitable gas, such as $CO_2$, ambient air, or other such substances. Furthermore, the source of compressed gas may be readily replaceable cartridges, as shown in FIG. 1, or may be compressed "on-demand" during firearm use by, for instance, using recoil or muzzle blast forces to compress the gas and provide a generally continuous supply to the apparatus. For other alternative force applicators, such as the electromechanical solenoid described above, the energy source would be, for instance, a electrical power source.

The switching means used to switch the returning means between the active and inactive states utilizes, in the preferred embodiment shown in FIG. 1, a two-port or three-port pneumatic solenoid valve 12 as the switchable component of the switching means (i.e., the component that is physically used to couple and decouple the force applicator and energy source of the returning means). The pneumatic cylinder 6 is connected to the source of compressed gas 10 via air lines, or hoses 14, that are connected to the ports of the valve 12. When the pneumatic valve is in the closed position, a third port may allow the pressure within the pneumatic cylinder to be released. Note that FIG. 1 also depicts the use of an optional pressure regulator 16 that may be employed as necessary.

The pneumatic solenoid valve 12 is actuated by an electrical circuit shown generally at 18. The circuit 18 includes an electrical power source 20, an electrical controller 22 and a trigger position switch 24. The valve 12, power source 20 and switch 24 are electrically connected to the controller 22 as shown by electrical connections generally 26. In a preferred embodiment, the controller 22 is a microchip, printed circuit board or combination thereof that receives electrical input signals from the switch 24 and operates to energize the solenoid valve 12 with electrical power from the power source 20 as appropriate. The power source 20 may be a battery or any other such power source sufficient to open and close the valve 12. The details of the switch 24 and its use are described more fully in connection with FIGS. 2-4 below.

Figure 2:
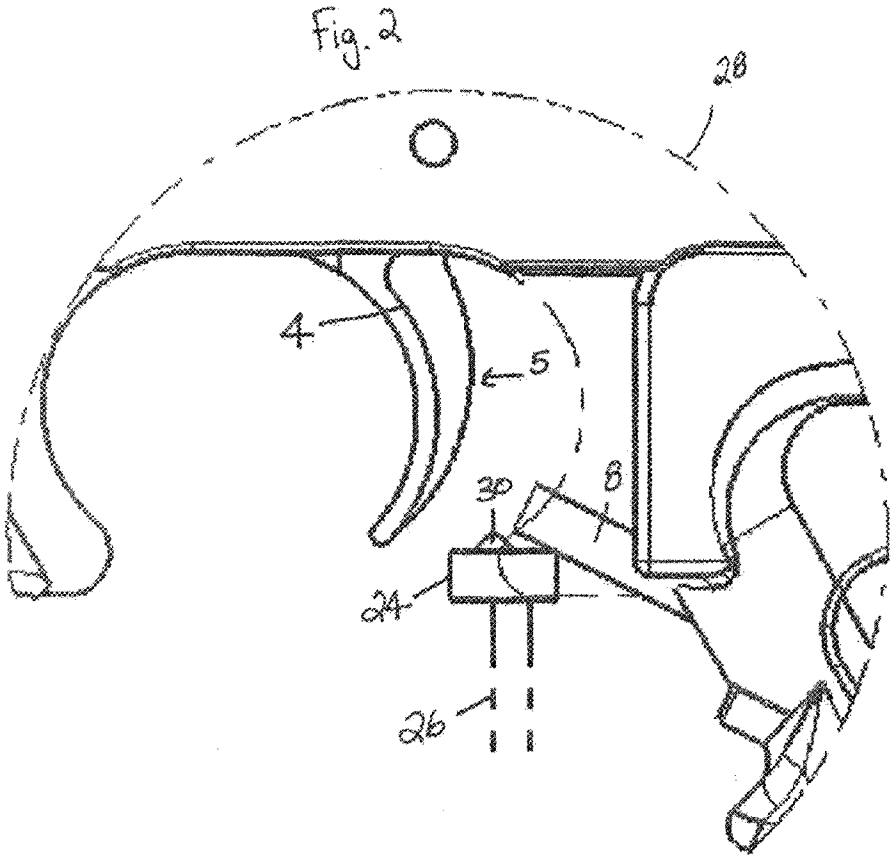
FIG. 2 depicts a detail view of the trigger area of the firearm and embodiment shown in FIG. 1 in interaction of the apparatus with the trigger is described in connection with a firing cycle.

Turning to FIG. 2, the trigger area 28 of FIG. 1 is shown in detail. The trigger 4 is shown in a fire ready position. Some portions of the firearm 2 are shown in phantom to better illustrate the operation of the apparatus. The pneumatic cylinder 6 rod 8 is shown in a retracted state in such a location that it will not interfere with the trigger travel unless the returning means is activated, thereby driving the rod 8 forward. When the rod 8 engages the trigger 4, providing a returning force to rapidly return the trigger 4 to the fire ready position shown in FIG. 2, it will push on a back surface 5 of the trigger 4. For other orientations of the force applicator, a linkage adapted to pull the trigger forward may be utilized if desired.

The switch 24 is shown as a two position rocker type switch having a rocker 30. The switch 24 should be generally positioned or mounted on the firearm at a location rearward from the trigger 4 and in such a manner so as to avoid interfering with the normal operation of the firearm, but also so that the trigger 4 contacts the rocker 30 at a trigger reset position. The selection of the reset position will vary based upon the particulars of the firearm, and its optimal location will be readily apparent to those skilled in the art upon reviewing the following disclosure.

Figure 3:
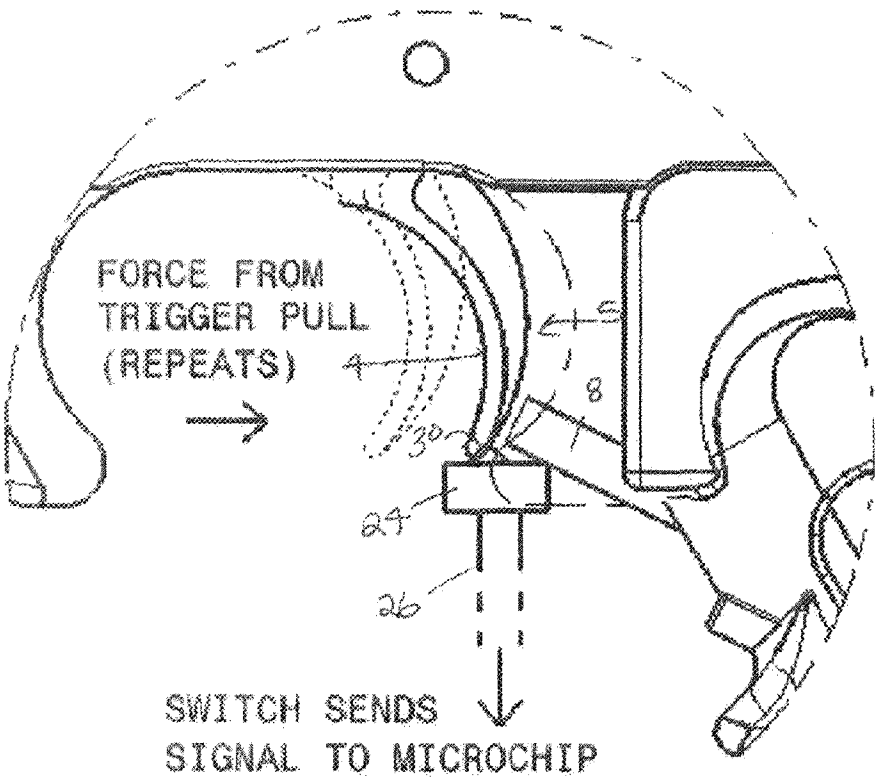
FIG. 3 depicts a detail view of the trigger area of the firearm and embodiment shown in FIG. 1 in interaction of the apparatus with the trigger is described in connection with a firing cycle.

Turning from FIG. 2, in which the firearm and apparatus are shown at rest, FIG. 3 depicts the firearm a short time after the trigger 4 has passed through the fire position, thereby actuating the firing mechanism and initiating the firing of a round. When the trigger 4 reaches the reset position shown in FIG. 3, it contacts the rocker 30 in switch 24. The contact between the trigger 4 and the rocker 30 send a signal via electrical connection 26 to the controller (22 in FIG. 1). The trigger 4 has reached the reset position by rearward travel (i.e., while traveling rearward, or still being pulled or squeezed by the shooter), which causes the switching means to switch the returning means to the active state by opening the solenoid valve 12 and driving the pneumatic cylinder 6 with the source of compressed gas 10.

Figure 4:
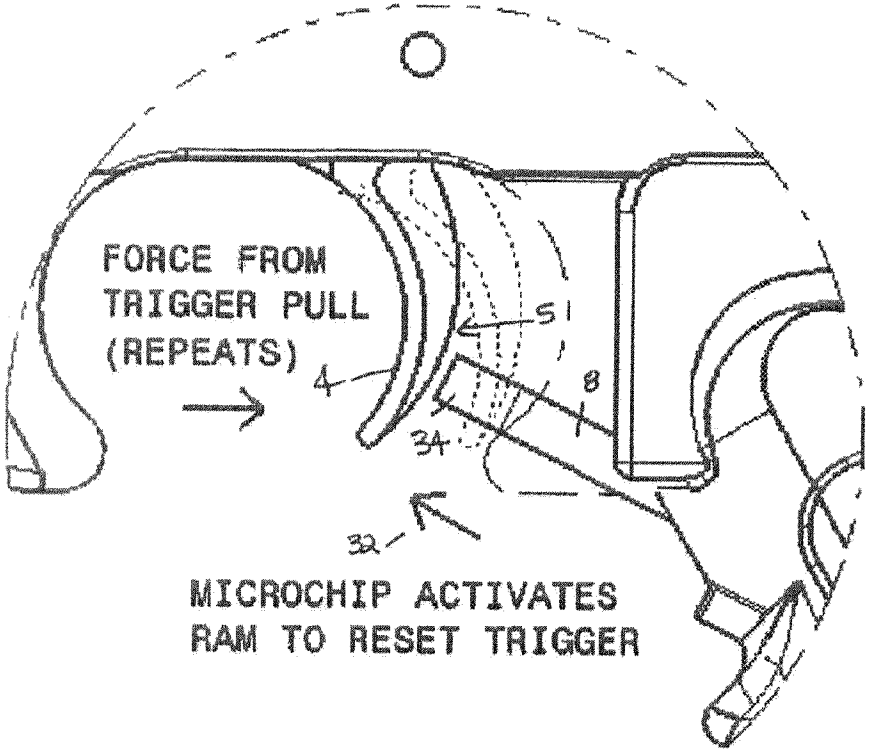
FIG. 4 depicts a detail view of the trigger area of the firearm and embodiment shown in FIG. 1 in interaction of the apparatus with the trigger is described in connection with a firing cycle.

Turning to FIG. 4, the pneumatic cylinder 6 has been driven, extending the rod 8 to engage the rear surface 5 of the trigger 4, rapidly moving the trigger 4 back to a fire ready position in the direction of arrow 32, after which the pneumatic cylinder disengages. The shooter will then be able to apply only the force necessary to fire the firearm, thus providing a rapid fire solution for semi-automatic firearms that does not affect the pull weight of the trigger.

The preferred embodiment utilizes the trigger position detecting means (e.g., 24 and 30 in FIGS. 2-4) to initiate the switching means to switch the returning means from the inactive state to the active state. The trigger position detecting means may also be used to determine when to switch the returning means back to the inactive state if, for instance, the trigger reset position is before the travel stop position, and the force applicator is configured to apply force only between those two positions.

A preferred embodiment utilizes a timing circuit incorporated into the electronic controller 22 as a means for determining when to switch the returning means from the active state to the inactive state (i.e., to avoid over forcing the trigger to a fire ready position, thereby impeding/altering natural trigger pull weight characteristics, or to allow the firearm sufficient time to cycle). The timing circuit tracks the time that has elapsed upon contact between the trigger and the rocker, and compares the elapsed time to a reference time that is preset. The timing circuit may compare directly at discrete intervals, deplete a time variable by subtracting time intervals until reaching zero, or any other such comparable methods. Based on the characteristics of the firearm, those skilled in the art will appreciate and be able to determine an optimal time or range of times after which the returning means should be inactivated and disengaged from the trigger to prepare for the subsequent round.

Other optional components may be incorporated into the disclosed invention to improve its performance. For example, FIG. 4 shows a magnetic portion 34 of pneumatic cylinder 6 rod 8. To more accurately determine when to switch the returning means to an inactive state in order to avoid increasing the force necessary to pull the trigger to fire the next round, a force applicator position detecting means may be optionally employed to measure the position of the force applicator at any given time in a firing cycle. A preferred embodiment utilizes a reed switch and magnetic rod to detect force applicator position and use the position to switch the returning means to the inactive state. The reed switch or applicator position detecting means generally is preferably incorporated onto the pneumatic cylinder 6. The force applicator position detecting means may also be used in conjunction with the timing circuit to enhance the characteristics of the apparatus. For instance, the switching means may be adapted to switch the returning means from the active to inactive state when a certain time has elapsed or the rod has reached a preselected forward, or extended position. In other embodiments, both conditions may be required to be met before the switching occurs.

The timing circuit may also be used to delay the activation of the returning means for some time after the trigger has reached the reset position. This may be desirable for firearms with little to no trigger over travel. The timing circuit may also be used to optionally only allow the apparatus to cycle a specific number of times within a timeframe, or to pause after every N cycles in order to achieve the illusion of burst fire.

If fast cycle times are desired, the force applicator may be equipped with a return spring to more quickly retract and disengage the force applicator from the trigger in preparation for the following cycle. Timing performance may also be enhanced, for example, through the use of a direct mechanical linkage between a reciprocating component of the firearm (e.g., the bolt, slid or other reciprocating component) and the switchable component of the switching means may be substituted in lieu of the electronic circuit 18 as the switching means. The use of such a linkage in conjunction with the switchable component (e.g., valve 12) would operate in a manner similar to drop in auto sears, and could be employed to open a 3- or 4-way pneumatic valve as the bolt carrier moves rearward, then close the valve as the bolt carrier returns to its forward position.

Other trigger position detecting means include the use of recoil or report sensitive switches to determine trigger position and, in conjunction with a force applicator position detecting means, a timing circuit or both, used to determine the timing optimal for switching the returning means between the active and inactive states.

Figure 5:
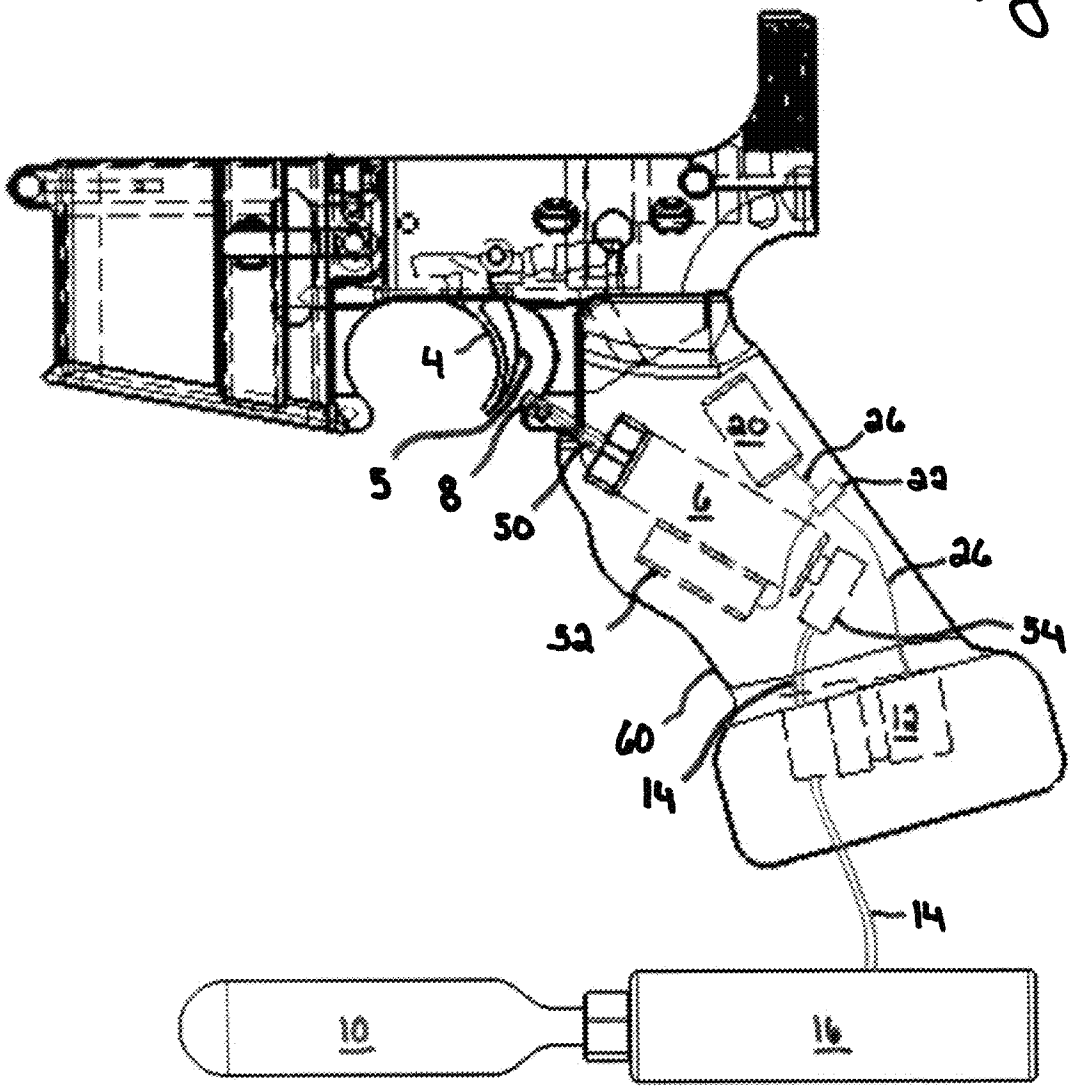
FIG. 5 depicts a side view of a semi-automatic style firearm with the components of another embodiment of the invention in schematic layout.

Turning now to FIG. 5, another exemplary embodiment of the inventive concept is illustrated. As with the embodiment in FIG. 1, this embodiment includes a pneumatic cylinder 6 having an extendable plunger 8 used as a force applicator. It is understood that other force applicators may be used. This embodiment again uses a source of compressed gas 10 to drive the pneumatic cylinder 6 in the active state. AS with other embodiment, the source of compressed gas 10 may be a readily replaceable cartridge or may be "compressed" on demand during firearm use by using recoil or muzzle blast energies to compress gas and provide a generally continuous supply. As in other embodiments, a pneumatic solenoid valve 12 is used as the switchable component of the switching means. The pneumatic cylinder 6 is connected to the source of compressed air 10 by air lines 14 that are connected to the ports of the valve 12. An optional regulator 16 may also be employed.

In this embodiment, the pneumatic valve 12 is actuated by an electrical circuit shown generally as 18. The circuit 18 includes an electrical power source 20, an electrical controller 22 and a reed switch 52. The valve 12, power source 20 and reed switch 52 are generally connected to the controller 22. The controller 22 receives electrical input signals from the reed switch 52 and operated to energize the solenoid valve 12 with electrical power from the power source 20.

As illustrated in FIG. 5, the trigger 4 is shown in the fire ready position. The pneumatic rod 8 and cylinder 6 are shown in the retracted state in such a location that it will not interfere with the trigger travel unless the returning means is activated, thereby driving the rod 8 forward. Rather than having a switch 24 with a rocker 30 as shown in FIG. 2, this embodiment of the inventive concept utilizes a rod 8 having a magnetic core 50 and a reed switch 52 positioned so as to sense the movement of the magnetic core 50 within the cylinder 6. To active the invention, the trigger is pulled passing through the firing position, where the trigger 4 contacts the rod 8. The impact of the trigger 4 with the rod 8 causes the rod 8 to be forced into the cylinder 6. The position of the rod 8 is detected by the reed switch 52. The reed switch 52 then sends a signal via the electrical connection 26 to the controller 22. The controller 22 then directs the valve 12 to open driving the pneumatic cylinder 6 with the source of compressed gas 10.

The pneumatic cylinder 6 is then driven, extending the rod 8 to engage the rear surface 5 of the trigger 4, rapidly moving the trigger 4 back to the fire ready position, after the cylinder disengages. The extension of the rod 8 is then registered by the reed switch 52 in close proximity to the cylinder 6. Once the rod 8 and the magnetic core 50 therein has traveled a predetermined distance, reached a predetermined time or a combination of time & distance, the reed switch 52 sends a signal via electrical connection 26 to the controller 22. The controller 22 in turn directs the pneumatic valve 12 to vent. A mechanical exhaust valve 54, may be positioned on the pneumatic cylinder 6, which is caused to open by the drop in pressure from the venting valve 12, allowing for accelerated exhaust of the gas from within the cylinder 6. Once the trigger 4 is in the fire ready position, the shooter will be able to apply a force necessary to fire the firearm, thus providing a rapid fire solution for semi-automatic forearms that does not significantly affect the pull weight of the trigger 4. Once the trigger 4 again passes through the firing position, the process starts again wherein the reed switch 52 detects that movement of the magnetic core 50 within the rod 8 moving a predefined length into the cylinder 6 and initiating the process to extend the rod 8 to contact the trigger 4 forcing the trigger 4 back into the fire ready position.

Additionally, as disclosed the cylinder 6, valve 12, reed switch 52, exhaust valve 54, the electronic circuit 18, and all electrical connections 26 are housed within a grip 60 on the firearm so as not to interfere with the handling of the firearm. The compressed air 10 and optional regulator 16 may be positioned at any location on the firearm that would not interfere with the handling of the firearm or may be worn by the user. Furthermore, one of skill in the art should understand that the exhaust valve 54 may be used with any embodiment described herein.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain some of the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

What is claimed is:

1. An apparatus attachable to a firearm having a firing mechanism actuated by a trigger at a release position, comprising:

a returning means for forcibly returning the trigger to a fire ready position from a reset position, comprising:

a force applicator disengaged from the trigger when the trigger is in the fire ready position; and an energy source operably connected to the force applicator, wherein the returning means has an active state in which the force applicator is driven by the energy source and an inactive state in which the force applicator is not driven by the energy source; and a switching means for switching the returning means between the active and inactive states;

wherein the force applicator further comprises a pneumatic cylinder having a rod, and wherein the energy source is a source of compressed gas, whereby the rod is moved in the active state of the returning means to engage the trigger and apply force in the direction of the fire ready position;

wherein the source of compressed gas is a compressed gas container;

wherein the switching means further comprises:

a two-port pneumatic solenoid valve controlling a flow of the compressed gas from the compressed gas container to the pneumatic cylinder;

a trigger position switch mounted on the firearm that detects trigger position by contact with the trigger at the reset position;

an electrical power source; and an electrical controller electrically connected to the solenoid valve, the trigger position switch, and the electrical power source;

wherein the returning means is switched to the active state when the electrical controller opens the solenoid valve, and wherein the returning means is switched to the inactive state when the electrical controller closes the solenoid valve;

wherein the electrical controller opens the solenoid valve when the trigger position switch detects that the trigger has reached the reset position by rearward travel; and wherein the switching means further comprises a pneumatic cylinder rod position detecting means electrically connected to the electrical controller.

2. The apparatus of claim 1, wherein the pneumatic cylinder rod further comprises a longitudinal magnetic section, and wherein the pneumatic cylinder rod position detecting means further comprises a reed switch that detects rod position.

3. The apparatus of claim 1, wherein the electrical controller closes the solenoid valve when the reed switch detects that the pneumatic cylinder rod has reached a fully extended position.

* * * * *